US005167390A

United States Patent [19]

Baghdadi

[11] Patent Number: 5,167,390

[45] Date of Patent: Dec. 1, 1992

[54] FLEXIBLE BAGS MOUNTING AND DISPENSING SYSTEM

[76] Inventor: Ghassan Baghdadi, 24 Barrington Crescent, Markham, Ontario, Canada, L3R 3H3

[21] Appl. No.: 776,190

[22] Filed: Oct. 15, 1991

[51] Int. Cl.[5] ..... B65B 67/04

[52] U.S. Cl. ..... 248/99; 248/95

[58] Field of Search ..... 248/95, 97, 99, 100, 248/101, 150, 153; 141/391; 220/404; 53/390

[56] References Cited

U.S. PATENT DOCUMENTS

| | | | |
|---|---|---|---|
| 3,132,794 | 5/1964 | Frazier | 248/99 X |
| 3,260,488 | 7/1966 | Kliewer | 248/99 |
| 3,313,504 | 4/1967 | Stoltze | 248/99 |
| 3,563,505 | 2/1971 | Langley | 248/101 |
| 3,653,619 | 4/1972 | Plum | 248/99 |
| 3,724,921 | 4/1973 | Lake | 248/99 X |
| 3,912,208 | 10/1975 | Grenetier | 248/101 X |
| 4,238,868 | 12/1980 | Sternberg | 248/101 X |

FOREIGN PATENT DOCUMENTS

| | | | |
|---|---|---|---|
| 2515018 | 10/1976 | Fed. Rep. of Germany | 248/101 |

*Primary Examiner*—J. Franklin Foss
*Attorney, Agent, or Firm*—David W. Wong

[57] ABSTRACT

This system is a flexible bags mounting and dispensing system which has two equal length mutually parallel articulated arms hingedly mounted together at their front end by a cross member. Each articulated arm consists of three section members hingedly coupled together. A flexible bag can be mounted to the articulated arm through tubes or pipings provided at the edge portion of its opening. The bag can be opened for filling operation by pulling the middle section members of the articulated arms away from each other, and the bag can be kept in a closed condition by pushing the articulated arms back to their parallel condition.

5 Claims, 3 Drawing Sheets

FLEXIBLE BAGS MOUNTING AND DISPENSING SYSTEM

BACKGROUND OF THE INVENTION

This invention relates to a bags mounting and dispensing system, and more particularly relates to a mounting and dispensing system for flexible bags such as plastic bags used for containing groceries, garbage and the like.

Flexible bags have a wide variety of uses. Normally the bags are provided in a stack in a folded manner or in a tied bundle so that a bag can be removed from the stack or bundle one at a time. Alternatively, the bags are supplied in a continuous roll with a score line provided between successive bags such that one bag at a time can be pulled off from the roll for use. In use, the bag must be expanded and its opening must be maintained in an opened state so as to facilitate its filling. For relatively small size bags such as groceries bags a simple bracket can be used to maintain the bag in an opened state for filling it with groceries. However, for larger bags such as a garbage bag or storage bag, it has been problematic to provide a simple bracket to maintain it in the opened position for filling purposes. Furthermore, the bracket can not be used for maintaining the bag also in a closed position for storage purposes such that the material stored in the bag is safely sealed therein. Also, it has been always difficult for a user in finding the bag of a correct size to fit properly in the bracket or container; more commonly people would use bags from their everyday shopping, with some being too small, or too big, or very thin, or not strong enough to serve the purpose. And with the environment being at risk, there is a definite need for the use of only recyclable and biodegradable bags, which is not normally the case for shopping bags. Yet another problem with conventional bags is in closing the bag when it is filled and it is required to be replaced. It is extremely difficult to tie the top edges of a filled bag or to use a string to wrap around the bag since there is not enough bag material left unfilled to be pulled together. This is because people normally have the tendency of not replacing the filled bag unless it is very full, thus not leaving any room at the top of the bag for tying. With all of the above mentioned issues in mind, the system disclosed herein was developed, solving all the problems of finding the correct bag, mounting it, maintaining it in an open state, temporarily closing the opening whenever it is desirable, closing the bag to be removed, and finding a replacement bag after the filled bag is removed.

SUMMARY OF THE INVENTION

It is a principal object of the present invention to provide a mounting and dispensing system which greatly facilitates the mounting of a flexible bag and it may be operative for maintaining a flexible bag in the opened position for filling operation as well as in a closed position for storage purposes and in the case of storing a material with obnoxious odour, the odour will be inhibited from emitting into the atmosphere.

It is another object of the present invention to provide a mounting and dispensing system which greatly facilitates the closing or tying of a filled bag.

It is another object of the present invention to provide a mounting and dispensing system which readily provides a plurality of bags for easy access for use, and providing a continuous supply of bags.

It is another object of the present invention to provide a mounting and dispensing system which readily provides a plurality of bags the are recyclable and biodegradable.

It is another object of the present invention to provide a mounting and dispensing system which readily provides a replacement bag that is already mounted and ready to be used as soon as the current bag is removed.

It is another object of the present invention to provide a mounting and dispensing system which serves as a convenient mounting means for a plurality of flexible bags for easy access for use.

It is another object of the present invention to provide a mounting and dispensing system for flexible plastic bags which is simple in structure and easy to operate.

The flexible bags mounting and dispensing system primarily comprises a right articulated arm member and a left articulated arm member mutually parallel to each other and are equal in length. Each of the articulated arm member has at least three section members, namely a front section member, a middle section member and a rear section member. The front section member has a rear end hingedly coupled to the front end of the middle section member. The other end of the middle section member is hingedly coupled to the front end of the rear section member. The rear end portion of the rear section member has an L-shaped portion operative for mounting the system in a cantilever manner on a vertical mounting wall. The flexible bags have mounting pipings or loops provided on their opening edge portion such that the bags can be threading mounted on the rear section member of the articulated arms. A bag can be pulled over the front section member and the middle section member for use.

The system is set up in such a way that when the arms are pushed towards each other, the system becomes in a closed state, where the arms form two parallel lines. However, when the arms are pulled away from each other, they are no longer in parallel, and the system becomes an open state. The basic idea is that when the arms are in parallel, i.e., the system is in a closed state, a bag mounted on the arms through pipings provided on its opening edge portion can be pulled along the arms all the way until the end of the arms, thus providing an empty bag in a closed state mounted on the arms. With this system, it is therefore extremely easy to mount a bag onto the arms since all that is required is to slide the bag along the arms. Also, the problem of finding the correct type and size of bag to use is eliminated since the bags are readily available. For opening the bag in use, the arms are simply pulled away from each other. The expansion of the arms will cause the bag to open and to be ready for use. Whenever the bag is not being used, it can be kept closed by simply pushing the arms towards each other, hence the parallel arms maintain the bag securely closed to protect its contents. Whenever the bag is filled or is required to be replaced, the arms are first pushed to the parallel positions, then the filled bag can be pulled along the parallel arms all the way until the pipings on its opening edge are tightly squeezed. The system thus greatly facilitates the action of tying the filled bag. After tying the bag, it can be removed by using a cutter provided at the end of the arms. As the filled bag is being pulled along the arms to be removed, the next bag is automatically pulled forwards onto the arms to become ready for use, since the bags are serially connected to each other.

DETAIL DESCRIPTION OF PREFERRED EMBODIMENTS

Figure 1:
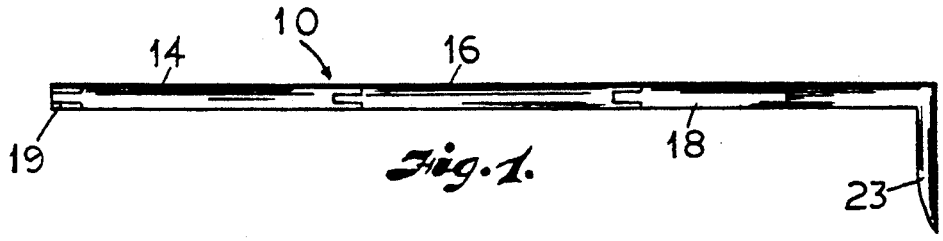
FIG. 1 is a side elevation view of the articulated mounting and dispensing arm member for the flexible bags according to the present invention.
Figure 2:
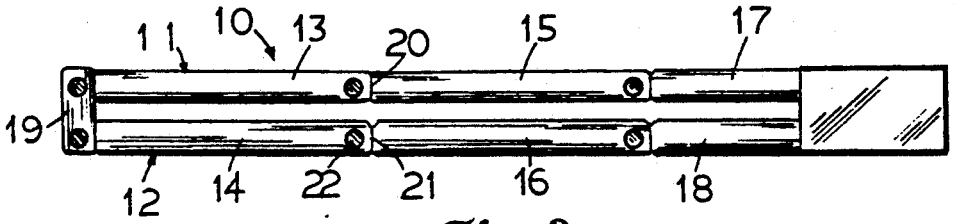
FIG. 2 is a top elevation view of the articulated mounting and dispensing arm member in the closed position.
Figure 3:
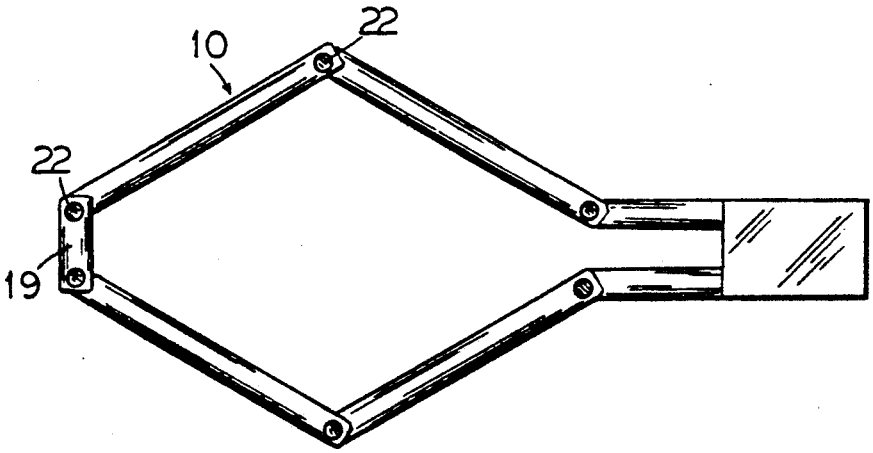
FIG. 3 is a top elevation view of the articulated mounting and dispensing arm member in the opened position.
Figure 4:
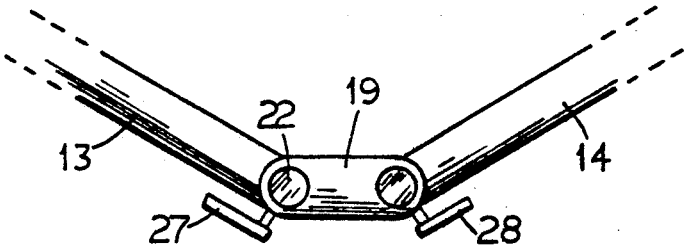
FIG. 4 is an isolated top elevation view of the front portion of the articulated arm member with bag cutting means incorporated therein.

With reference to the drawings wherein like reference numerals indicate same parts in the several different views, the system of the present invention includes an articulated bracket 10 having two equal length articulated arms 11 and 12. The articulated arms 11 and 12 are normally mutually positioned parallel to each other and each comprises of at least three section members, namely, front section members 13, 14, middle section members 15, 16, and rear section members 17, 18 respectively. The front end of the front section members 13 and 14 are pivotally coupled together and preferably hingedly coupled to a short cross member 19 as best shown in FIGS. 2, 3 and 4. The rear end of the front section members 13 and 14 are respectively hingedly coupled to one end of the middle section members 15 and 16 respectively to form pivotal operating joints 20 and 21. These joints preferably have a configuration similar to a tongue and groove joint in which a slot is formed at the end of one section while a tongue-like end extension section is formed in the other section. The extension section is pivotally fitted into the slot of the associated section and the two sections are pivotally secured together by a pin 22. The other end of the middle section member 15 and 16 are respectively hingedly coupled to the front end of the rear section member 17 and 18 with similar tongue and groove joints. The rear portion of the rear section member 17 and 18 are connected to an L-shaped mounting section 23 which may be operative for mounting the articulated bracket 10 in a cantilever manner by being inserted removably into a sheath bracket provided on a vertical mounting means such as a wall or a post.

Figure 5:
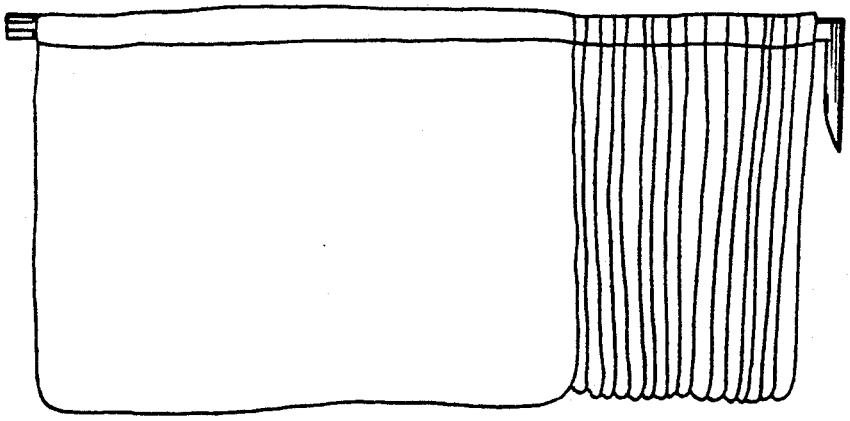
FIG. 5 is a side elevation view of the flexible bags mounting and dispensing system according to the present invention with the flexible bags mounted on the rear section member therein.
Figure 6:
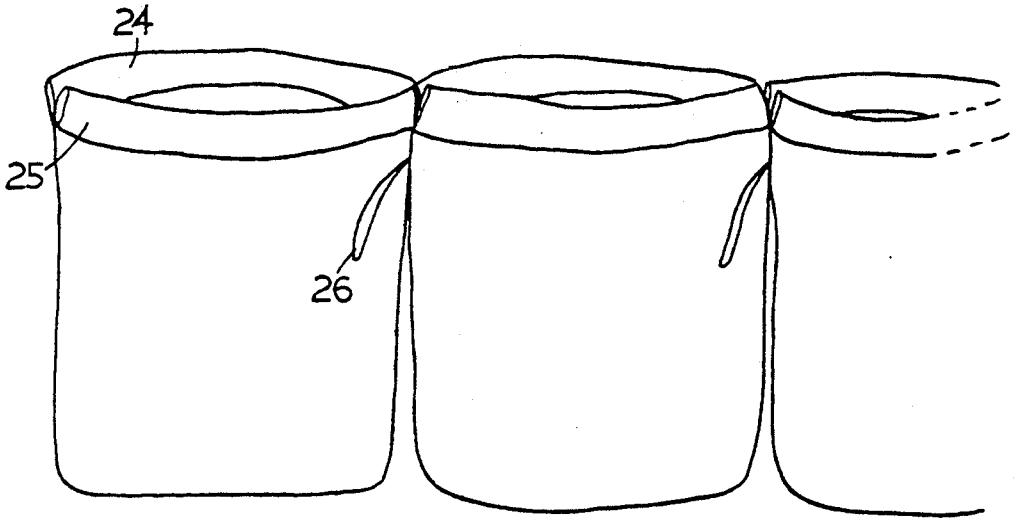
FIG. 6 is a perspective side elevation view of the flexible bags according to the present invention having mounting pipings or tubings provided in the edge portion of their opening.

The flexible bags for the present system have a reinforced double layer edge portion around its opening forming tubings or pipings 24 and 25 along each half portion therein. The bags may be joined together at their upper end portion such that the pipings 24 and 25 are continuous from bag to bag, so that the bags may be easily and simply mounted on the articulated arms 11 and 12 by inserting the latter through the pipings 24 and 25 respectively and pulling the bags tight together to hang onto the rear section member therein. The side of each bag may also be connected to the side of the bag next to it by perforated lines. The perforated lines will make it easier to separate the bags from one another. The width of each bag is equal to the total length of the front section member and the middle section member, thus one bag at a time for use may be pulled to extend over the front section member and middle section member as best shown in FIG. 5. The bags may be easily and simply mounted onto the articulated arms 11 and 12 by first disconnecting the bracket 10 from the mounting section 23, and then inserting the end of the rear section members 17 and 18 through the pipings 24 and 25 respectively and pulling the bags tightly together to hang onto the rear section members therein. The bracket 10 is then connected back to the mounting section 23 for mounting to the wall bracket. When a bag needs to be used, the first bag from the front end of the rear section members is pulled along the articulated arms to extend over the front and middle section members.

The articulated arms 11 and 12 normally maintain the opening of the bag for use in a closed condition. When it is required to fill the bag, the bag may be opened by pulling the operating joints 20 and 21 outwards away from each other so that the articulated arms 11 and 12 are extended in a diamond-shaped configuration as shown in FIG. 3 to maintain the bag in an opened condition. The bag may be closed again by simply pushing the operating joints 20 and 21 towards each other until the articulated arms 11 and 12 are in the parallel position again. Thus, the bag mounted on the articulated arms 11 and 12 may be used for temporary storage purposes until the bag is full then, if desired, it can be removed from the bracket. To remove a bag from the bracket, the bag is pulled towards the cross member 19 along the articulated arms all the way until the pipings on its top edge are squeezed around the front end arms of the front section members.

A tie 26 may be provided on the bag such that it is operative conveniently for tying the bag after it top after its top edges have been squeezed to close together.

Two spring-mounted severing cutters 27 and 28 are provided at the front end of the front sections 13 and 14 as best shown in FIG. 4. The cutters 27 and 28 may be operated to sever the pipings or tubings 24 and 25 of the bag such that the latter may be removed from the articulated arms 11 and 12 after it has been filled and tied by the tie 26. The filled bag may then be removed by pulling away along the perforated line from the next spared bag. Since the pipings 24 and 25 are continuous from bag to bag, whenever a bag is pulled towards the front of the bracket to be removed, a new bag is automatically pulled forward to replace it and it is already mounted on the bracket in a closed condition and is ready to be used as soon as the bracket is opened, as described above. This operation may be repeated until all the bags mounted on the rear section members are expended, at which point another group of bags may be mounted onto the rear section members as described above.

Figure 7:
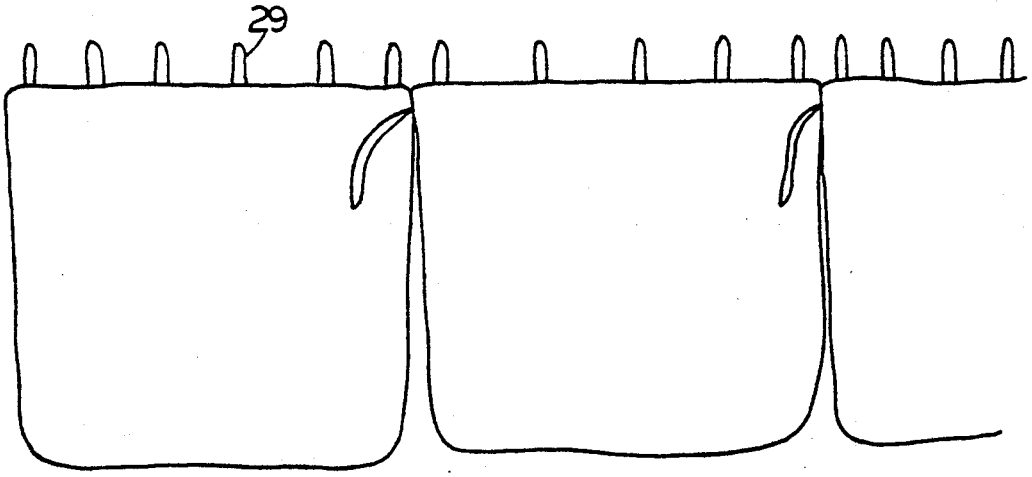
FIG. 7 is a perspective side elevation view of the flexible bags according to the present invention having a plurality of mounting loops provided in the edge portion of their opening.

Alternatively, the bags may have perforated lines at the top edge therein so that in order to remove each bag from the arms, the bag may be pulled down and it will break away from the mounting bracket along the perforated line. To further facilitate the removal of the bags from the arms, instead of pipings or tubings 24 and 25, the bags may be provided with a plurality of mounting loops 29 as shown in FIG. 7 and the bags may be mounted onto the articulated arms 11 and 12 with the loops 29. The loops may also be perforated at the top edge therein.

Figure 9:
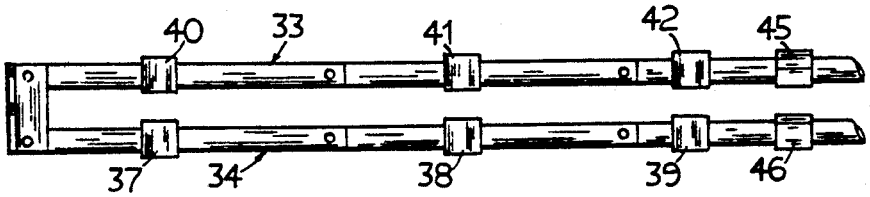
FIG. 9 is a partial top elevation view of the second embodiment thereof.
Figure 8:
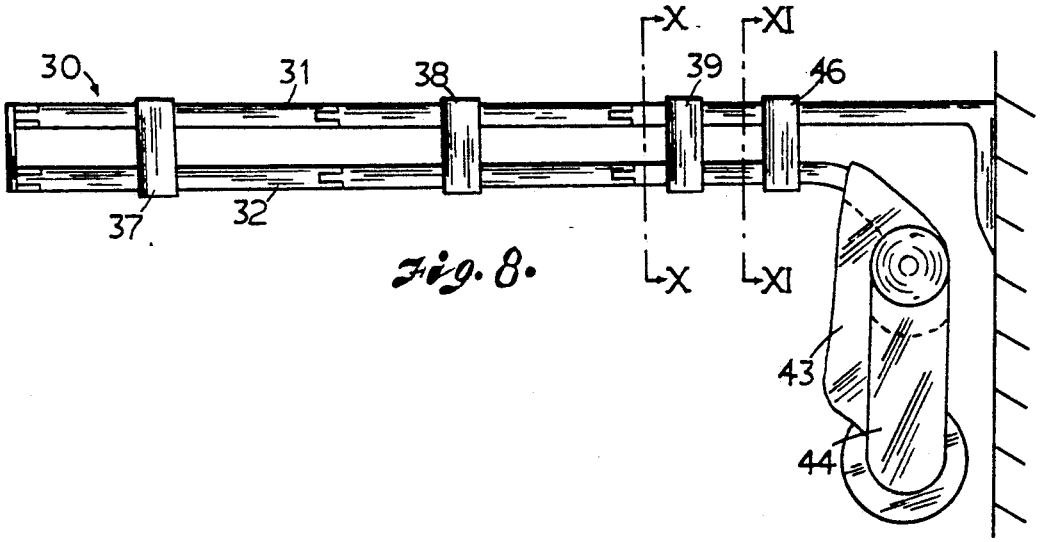
FIG. 8 is a perspective side elevation view of a second embodiment of the mounting and dispensing system according to the present invention with flexible bags supplied in a continuous roll.

In a second embodiment as shown in FIGS. 8 and 9, the mounting bracket 30 comprises of two sets of parallel articulated arms namely an upper articulated arms 31 and a lower articulated arm 32. Each articulated arm has a construction similar to the articulated arms 11 and 12 as described above. The upper articulated arm 31 has a left articulated arm 33 and a right articulated arm 34. The lower articulated arm has a left articulated arm 35 and a right articulated arm 36. Three inverted U shaped coupling brackets 37, 38, and 39 are provided at the front, middle and rear sections respectively of the upper left articulated arm 33, and three similar inverted U-shaped coupling brackets 40, 41 and 42 are provided at the front, middle and rear sections respectively of the upper right articulated arm 34. Each coupling bracket has an inner leg IL and an outer leg OL extending respectively downwards from the upper articulated bracket 31 to locate in a spaced manner on the inside and outside of the lower articulated arm 32. The coupling brackets 37 through 42 will cause the upper and lower articulated arms 31 and 32 to operate in unison with each other, namely, when the upper articulated bracket 31 is in the closed or opened condition selectively, the lower articulated arm 32 will also correspondingly be in the closed or opened condition simultaneously as selected.

Figure 10:
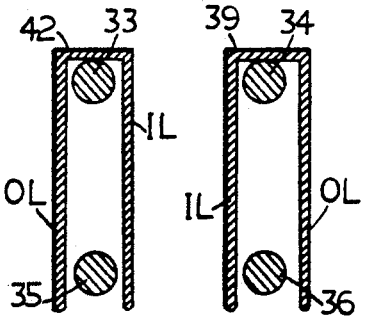
FIG. 10 is an enlarged front elevation sectional view along section line X—X of FIG. 8.
Figure 11:
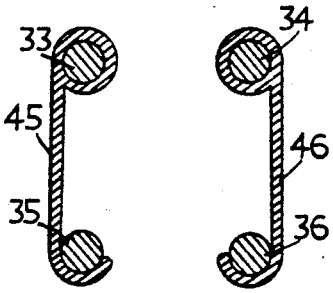
FIG. 11 is an enlarged front elevation sectional view along section line XI—XI of FIG. 8.

The free end of the lower articulated arm 35 and 36 curve slightly downwards such that a bag 43 may be pulled from a roll 44 to mount onto the lower articulated arms 35 and 36 similar to that described above for articulated arms 11 and 12 in the first embodiment. The spacing between the coupling brackets 37 through 42 permits the bags to be mounted without any obstacle. Reinforcing brackets 45 and 46 are pivotally mounted on the left upper articulated arm 33 and right upper articulated arm 34 respectively. These reinforcing brackets have a hook-shaped lower free end and they may be pivotally operated to position in a vertically downward position as shown in FIG. 10 such that they may be respectively and selectively securing the rear section of the upper and lower articulated arms 31 and 32 together to provide extra reinforcement of, particularly, the rear sections of the lower articulated arm 32 during its opening and closing operations. The reinforcing brackets 45 and 46 may be pivoted away to disengage from the lower articulated arm 32 during the mounting of the bags 43 thereto.

It can be appreciated by those skilled in the art that the system as shown in the second embodiment may have a reversed construction in which the lower articulated arm may be secured to the vertical wall and the upper articulated arm is provided with free ends for mounting the bags.

Obviously, numerous modifications and variations of the present invention are possible in light of the above teachings. It is therefore to be understood that within the scope of the appended claims, the invention may be practiced otherwise than as specifically described herein.

What is claimed is:

1. A flexible bags mounting and dispensing system comprising, an upper articulated arm member and a lower articulated arm member, each of said upper articulated arm member and lower articulated arm member including a right articulated arm member and a left articulated arm member hingedly joined at a front end therein and being substantially parallel and equal in length to each other, and having at least three section members including a front section member, a middle section member and a rear section member, said front section member having a rear end hingedly coupled to one end of said middle section member, and said middle section member having a second end hingedly coupled to a front end of said rear section member, said rear section member of said upper articulated arm member having an L-shaped rear end portion operative for mounting said upper articulated arm member to a vertical mounting surface, said lower articulated arm member being operative for mounting said bags thereon, a fixed mounting bracket means secured to the front end of said upper articulated arm member and said lower articulated arm member, a plurality of inverted U-shaped bracket means mounted to said upper articulated arm member, said U-shaped bracket means having two leg members extending downwards from said upper articulated arm member and positioned in a spaced manner from said lower articulated arm member.

2. A flexible bags mounting and dispensing system according to claim 1 including a plurality of flexible bags provided in a continuous roll having successive bags joined together at the top side edge portion therein by an impression line, said bags having an edge portion provided with a piping operatively engageable with said articulated arm members of said lower articulated arm member for mounting thereon.

3. A flexible bags mounting and dispensing system according to claim 2 wherein said bags having a tying means provided thereon close to the top opening therein.

4. A flexible bags mounting and dispensing system according to claim 3 including cutting means disposed at said lower articulated arm member and being operative to sever a selected bag therefrom.

5. A flexible bags mounting and dispensing system according to claim 2 wherein said upper articulated arm member and said lower articulated arm member are reversed, and said upper articulated arm member is provided with a free end for receiving said bags to be mounted thereon, and a plurality of substantially U-shaped brackets are mounted to the lower articulated arm member and having leg members thereon extending upwards to position in a spaced manner from said upper articulated arm member.

* * * * *